US005211689A

United States Patent [19]

Kobayashi

[11] Patent Number: 5,211,689

[45] Date of Patent: May 18, 1993

[54] WATER-ACTIVATING PARTICLE CASING WITH AN ANNULAR FLOAT

[76] Inventor: Nobutaka Kobayashi, 26-1202 Wakabadai 2-chome, Asahi-ku, Yokohama-shi, Japan

[21] Appl. No.: 801,799

[22] Filed: Dec. 2, 1991

[30] Foreign Application Priority Data

Nov. 30, 1990 [JP] Japan ..... 2-129811

[51] Int. Cl.[5] ..... D06F 35/00; F17C 13/00; A24F 25/00

[52] U.S. Cl. ..... 206/0.5; 239/57; 68/17 R

[58] Field of Search ..... 206/0.5; 239/57; 68/17 R; 220/902

[56] References Cited

U.S. PATENT DOCUMENTS 3,677,711 7/1972 Bond ..... 239/57 X

*Primary Examiner*—William I. Price

[57] ABSTRACT

The invention is a water-activating particle casing with an annular float. The casing has openings to allow washing water to flow in and out from the casing and contact the water-activating particles contained therein, thereby increasing the cleaning capability of the washing water circulating in a washing vessel. The annular float is made of closed cell rubber, and surrounds a portion of the body of the casing, thereby permitting the casing to float and ride on the swirling circulation of washing water in the washing vessel. Thus, the water-activating particles can be effectively exposed to circulating washing water to permit their surface activities to be used to their limit in washing.

11 Claims, 5 Drawing Sheets

WATER-ACTIVATING PARTICLE CASING WITH AN ANNULAR FLOAT

BACKGROUND OF THE INVENTION

1. Field of the Invention:

The present invention relates to a Water-activating particle casing, and more particularly to a Water-activating particle casing equipped with an annular float which permits the casing to float and ride on circulating of washing water in a washing vessel.

As is well known, in almost all cases washing is performed with the aid of cleaning materials or cleansers added to washing machines. The amount of washing material used is often determined arbitrarily by individuals, and there is a tendency to use more washing material than required. Use of excessive washing material is economically disadvantageous, and leads to unused washing material entering sewer systems and, finally spoiling rivers and seas and in general causing environmental damage.

In an attempt to save washing material and prevent the public nuisance, water-activating particle casings are put in washing vessels along with clothes and other objects to be washed. Examples of water-activating materials used are tourmaline, and ceramic powder capable of radiating far infrared rays or piezoelectric ceramic material. For instance, tourmaline has the effect of putting water in an electrochemically unstable condition in which there appear free ions of $OH-$ having no counter ions of $H+$, thereby causing surface activities such as penetration, colloidization, dispersion, emulsionization or non-attachment at the interface between the clothes and the washing water. Also, it has the effect of significantly increasing oxidization-and-reduction reactions and oxygen solubility. These effects will expedite the cleaning of clothes and other objects in washing. Such water-activating materials are reduced to particles, thereby increasing the surface area at which they can contact surrounding washing water. Water-activating particles are contained in a casing.

The casing, however, must be strong enough to resist the force applied thereto in washing. The specific gravity of the material of which the casing is made is larger than that of water, and the specific gravity of the water-activating material is also larger than that of water, too. Therefore, the casing containing water-activating particles will sink in water and therefore, the water-activating particles can work only on the bottom of the washing vessel. In the hope of permitting water-activating particles to work effectively, the water-activating particle casing is put in a bag, which is attached to the inside of the washing vessel of washing machine for putting waste thread or rubbish therein when appearing in the washing water.

The water-activating particle casing thus put in the bag does not sink to the bottom of the washing of the washing vessel, but floats on the surface of the washing bath. The water-activating particle casing in a bag, however, can move in only a limited space at one side of the washing vessel, and therefore the water-activating particles cannot be brought in contact with washing water efficiently. Specifically, washing water cannot be subjected to the activating effect provided by the water-activating particles because the water-activating particle casing remains aside from the swirling circulation of washing water caused in the washing vessel.

Also, disadvantageously unpleasing sound or vibration is liable to be caused by the water-activating particle casing when striking against the inside wall of the washing vessel.

SUMMARY OF THE INVENTION

In view of the above, one object of the present invention is to provide a water-activating particle casing which permits the full use of the water-activating particles contained therein by increasing the contact between water-activating particles and washing water, so that clothes and other objects may be cleaned well with the aid of the surface activity caused by water-activating particles such as penetration, colloidization, dispersion, emulsionization or non-attachment at the interface between clothes and washing water.

Another object of the present invention is to provide a water-activating particle casing which prevents unpleasing sound or vibration when the casing strikes against the inside wall of the washing vessel.

To attain these objects a water-activating particle casing according to the present invention is composed of an apertured casing having an annular float of closed cell rubber therearound, thereby permitting said casing to float and ride on the swirling circulation of washing water in the washing vessel.

The annular float of closed cell rubber permits the casing to float on the surface of the washing bath, riding on the swirling circulation of washing water. The effective use of the surface activity caused by water-activating particles permits the cleaning of clothes and other objects without using cleaning material as much as would be required if water-activating particles were not allowed to work to their limit.

Other objects and advantages of the present invention will be understood from the following description of Water-activating particle casings according to preferred embodiments of the present invention, which are shown in accompanying drawings.

DESCRIPTION OF PREFERRED EMBODIMENTS

Figure 3:
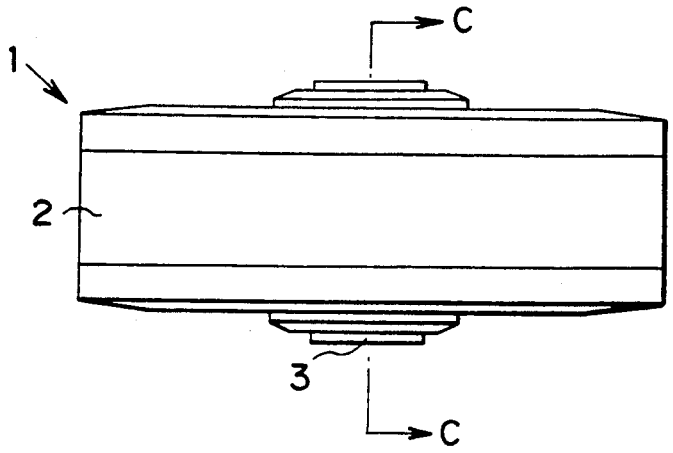
FIG. 3 is a side view of the water-activating particle casing according to the first embodiment of the present invention.
Figure 7:
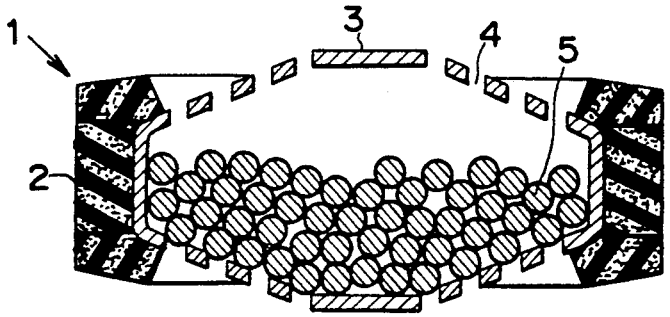
FIG. 7 is a section taken along the line C—C in FIG. 3.

FIGS. 3 and 7 show a water-activating particle casing according to the first embodiment of the present invention. The water-activating particle casing 1 comprises an apertured casing body 3, Water-activating particles 5 contained therein, and an annular float 2 surrounding the casing body 3.

Figure 1:
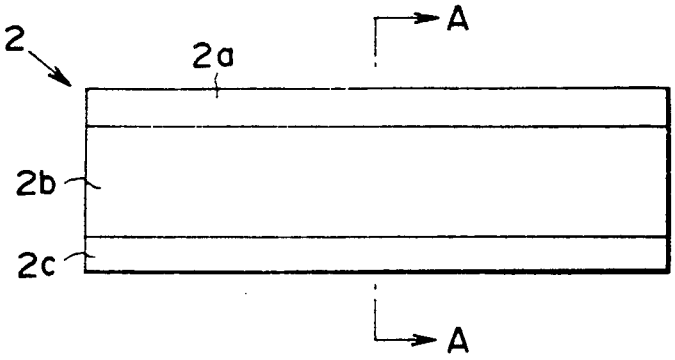
FIG. 1 is a side view of the annular float of a water-activating particle casing according to a first embodiment of the present invention.
Figure 2:
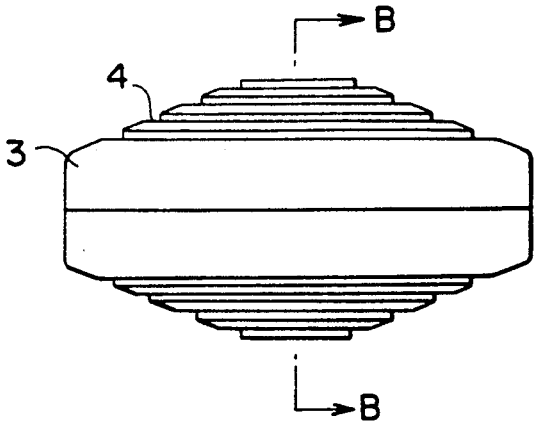
FIG. 2 is a side view of the casing body of the water-activating particle casing according to the first embodiment.
Figure 5:
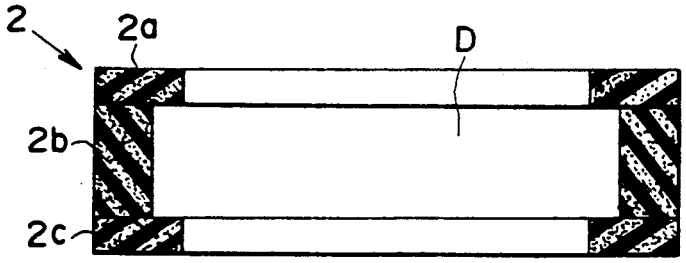
FIG. 5 is a section taken along the line A—A in FIG. 1.
Figure 6:
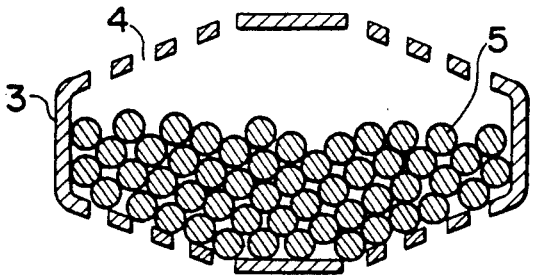
FIG. 6 is a section taken along the line B—B in FIG. 2.

The annular float 2 is made of closed cell rubber, and it comprises upper annular section 2*a*, annular barrel 2*b* and lower annular section 2*c*, thus defining a space D as seen from FIGS. 1 and 5.

The casing body 3 has a circular circumference, and its upper and lower surfaces have concentric slots 4 water-activating particles 5 are contained in the casing.

Examples of such water-activating material are: tourmaline, ceramic power capable of radiating far infrared rays or piezoelectric ceramic material. These materials are capable of providing surface activities and of significantly increasing oxidization-and-reduction and oxygen solubility.

Figure 4:
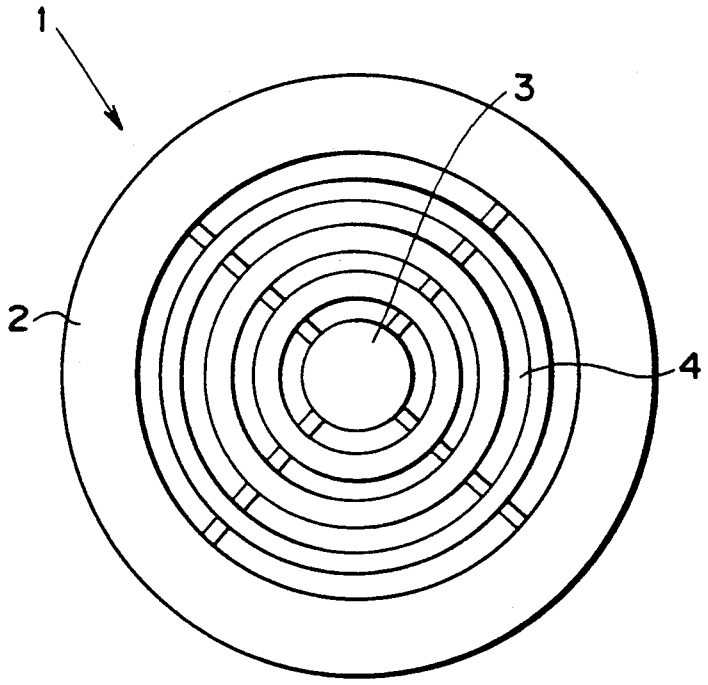
FIG. 4 is a plane view of the Water-activating particle casing according to the first embodiment of the present invention.

As shown in FIGS. 3, 4 and 7, the casing body 3 containing water-activating particles is fitted into the annular float 2 to be clamped between the upper and lower annular sections 2*a* and 2*c* of the casing body 3. Thus, a water-activating particle casing having annular float therearound results.

The manner in which such a floatable, water-activating particle casing 1 is used is described below.

Water and cleanser are put in the washing vessel of washing machine. Thanks to the effect of making cleaning easier and more effective by water-activating particles, a relatively small amount of cleanser need be added to the water.

Clothes and other objects to be washed along with the floatable, water-activating particle casing 1 are put in the washing vessel of the washing machine. The floatable, water-activating particle casing 1 floats on the surface of the washing bath, allowing washing water to get in the casing 3 through its slots 4 and come to contact with the water-activating particles 5.

Figure 8:
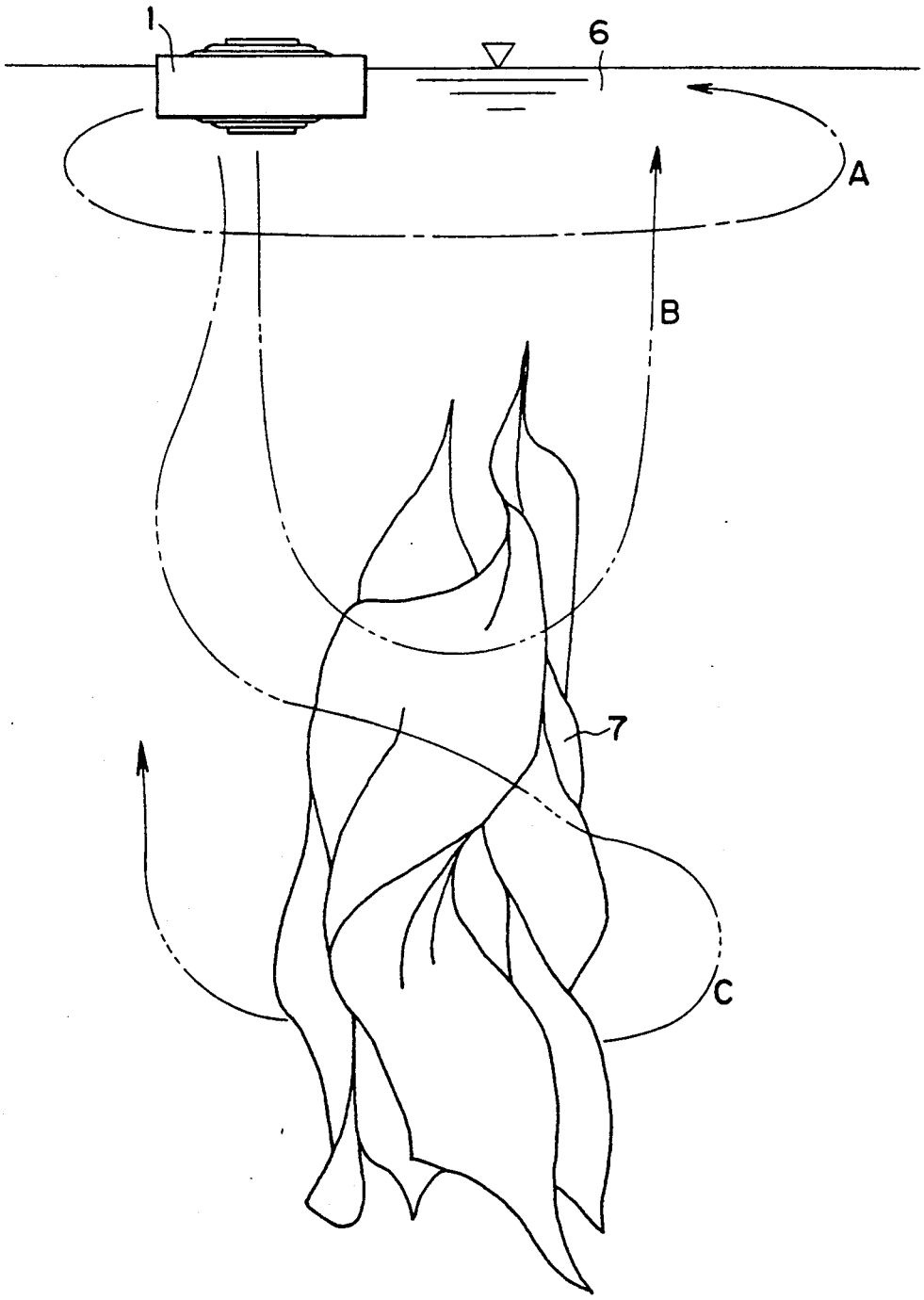
FIG. 8 shows how the water-activating particle casing moves in the washing vessel.

When the washing machine is put in operation, washing water starts swirling circulation in the vessel of the machine. As shown in FIG. 8, clothes 7 move around in the washing bath, and then, the floatable, water-activating particle casing 1 rides on the swirling circulation of washing water, moving in all directions. For instance, it moves on the surface of the washing bath as indicated by arrow A; it goes down in the washing bath and comes upto the surface of the washing bath as indicated by arrow B; and it moves together with the moving clothes 7 as indicated by arrow C. While the water-activating particle casing 1 is moving about the washing bath, water 6 gets in and out from the inside of the casing 1, thus permitting washing water to contact the water-activating particles 5 evenly. Thanks to the annular float 2 of closed cell rubber surrounding the water-activating particle casing, no sound or vibration is caused when the casing strikes against the inside wall of the washing vessel.

As may be understood from the above, the buoyancy of the closed cell rubber permits the floating of the casing and water-activating particles on the surface of the washing water, thus riding on the swirling circulation of washing water, and moving in all directions. Washing water can be evenly brought in contact with the water-activating particles, and therefore, the cleaning of clothes is made easier and more effective, and accordingly cleanser can be saved. This permits reduction of the amount of used and unused cleanser to be discharged into rivers and seas through the sewer, and the public nuisance is reduced accordingly.

Figure 9:
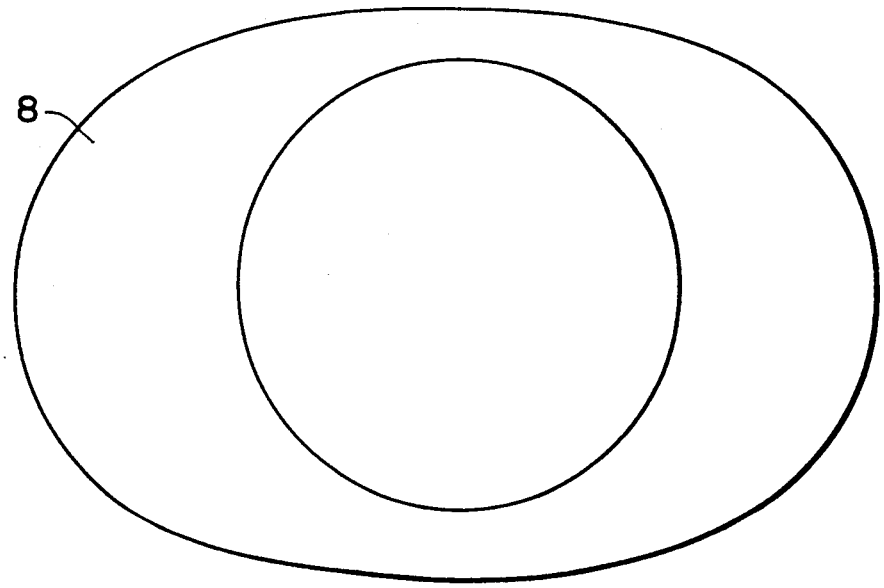
FIG. 9 is a plane view of the annular float of a Water-activating particle casing according to a second embodiment of the present invention.
Figure 10:
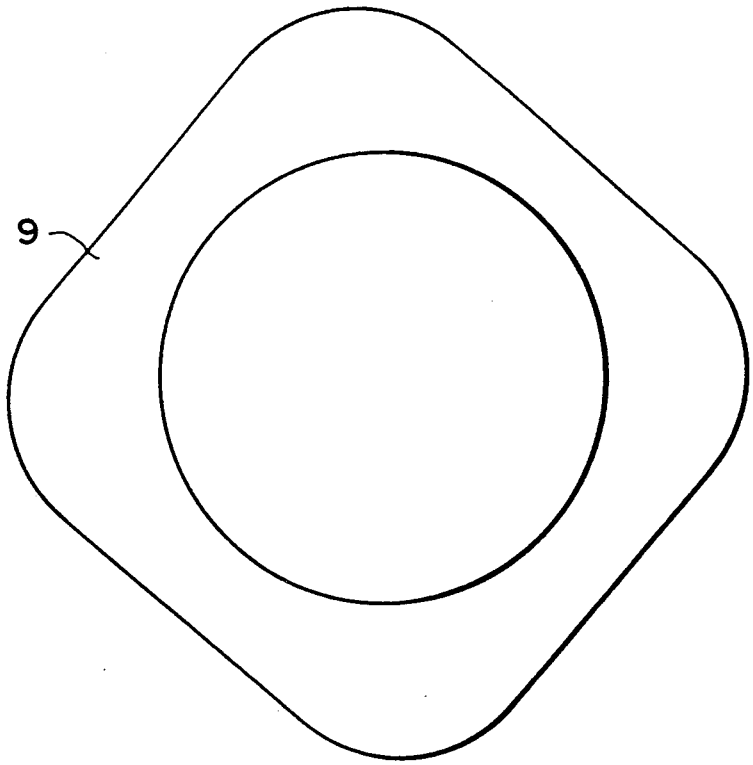
FIG. 10 is a plane view of the annular float of a Water-activating particle casing according to a third embodiment of the present invention.

The annular float may be of elliptical or square shape as indicated by 8 and 9 in FIGS. 9 and 10. The casing body may take any desired shape although it must have openings to permit water to get in and out from the casing.

What is claimed is:

1. A water-activating particle dispenser comprising:

a casing for containing water-activating particles, the casing having openings to allow water to flow into and out of an interior portion of the casing to contact water-activating particles; and a float surrounding the casing such that the float and the casing are concentric, the float being made of closed cell rubber and attached to the casing such that the float and casing together have positive buoyancy relative to water.

2. A water-activating particle dispenser according to claim 1, wherein the float has an annular shape and is attached to a perimeter of the casing by a tight friction fit.

3. A water-activating particle dispenser according to claim 1, wherein the float has a square shape and is attached to the casing by a tight friction fit.

4. A water-activating particle dispenser according to claim 1, wherein the casing is substantially cylindrical having an upper and a lower surface, and a circular perimeter surface such that the openings are on only upper and lower surfaces and the float surrounds the circular perimeter surface.

5. A water-activating particle casing with an annular float comprising:

a casing having openings to permit washing water to flow into and out of the casing to contact water-activating particles contained therein; and an annular float comprised of closed cell rubber and having a central opening such that the opening may be elastically fitted on an outer circumference of the casing, such that the casing and annular float floats and rides on circulating wash water and the casing openings are exposed to the circulating washing water.

6. A floating-type laundry aiding water-activating substance distributing assembly comprising:

a water-activating substance container defining a hollow chamber for enclosing therein a water-activating substance, said container having upper and lower end portions defining communication openings for free water communication between the interior and exterior of said container and an essentially cylindrical peripheral wall extending between said upper and lower end portions; and an annular elastic float body defining a central receptacle opening for receiving said container by elastically fitting the inner periphery of said receptacle opening onto the external surface of said peripheral body wall such that said upper and lower end portions remain exposed so that a washing water flowing in swirl fashion in a washing vessel of a washing machine may freely flow through said hollow chamber and contact said water-activating substance.

7. A floating-type laundry aiding water-activating substance distributing assembly as set forth in claim 6, wherein said central receptacle opening of said annular elastic float body has an interior surface configuration and size substantially similar to an external contour of said peripheral wall of said container.

8. A floating-type laundry aiding water-activating substance distributing assembly as set forth in claim 6, wherein said upper and lower portions of said container have tapered peripheral portions, and said float body has upper and lower inwardly extending flange portions elastically fitted on the peripheral edges of said tapered peripheral portions for gripping said container within said central receptacle opening.

9. A floating-type laundry aiding water-activating substance distributing assembly as set forth in claim 6, wherein said water-activating substance is one of the group comprising tourmaline, ceramic powder capable of radiating far infrared rays, and piezoelectric ceramic material.

10. A floating-type laundry aiding water-activating substance distributing assembly comprising:

a water-activating substance container defining a hollow chamber for enclosing therein a water-activating substance capable of providing surface activities and increasing oxidation and reduction and oxygen solubility, said container having upper and lower end portions defining communication openings for free communication between the interior and exterior of said container and an essentially cylindrical peripheral wall extending between said upper and lower end portions; and an annular elastic float body defining a central receptacle opening for receiving said container by elastically fitting the inner periphery of said receptacle opening onto the external surface of said peripheral wall such that said upper and lower end portions remain exposed so that a washing water flowing in swirl fashion in a washing vessel of a washing machine may freely flow through said hollow chamber and contact said water-activating substance.

11. A floating-type laundry aiding water-activating substance distributing assembly comprising:

a water-activating substance container defining a hollow chamber for enclosing therein a water-activating substance capable of providing surface activities and increasing oxidation and reduction and oxygen solubility, said substance being one of the group of tourmaline and ceramic powder capable of radiating far infrared rays, and piezoelectric ceramic material, said container having upper and lower end portions defining communication openings for free communication between the interior and exterior of said container and essentially cylindrical peripheral wall extending between said upper and lower end portions; and an annular elastic float body defining a central receptacle opening for receiving said container by elastically fitting an inner periphery of said receptacle opening onto an external surface of said cylindrical peripheral wall such that said upper and lower end portions remain exposed so that a washing water flowing in swirl fashion in a washing vessel may freely flow through said hollow chamber and contact said water-activating substance.

* * * * *